US011918853B2

(12) United States Patent
Chin

(10) Patent No.: US 11,918,853 B2
(45) Date of Patent: Mar. 5, 2024

(54) ADJUSTABLE AB WHEEL

(71) Applicant: T. K. CHIN COMPANY LTD., Taipei (TW)

(72) Inventor: Taan-Kuan Chin, Taipei (TW)

(73) Assignee: T. K. CHIN COMPANY LTD., Taipei (TW)

( * ) Notice: Subject to any disclaimer, the term of this patent is extended or adjusted under 35 U.S.C. 154(b) by 167 days.

(21) Appl. No.: 17/830,457

(22) Filed: Jun. 2, 2022

(65) Prior Publication Data

US 2023/0094565 A1 Mar. 30, 2023

(30) Foreign Application Priority Data

Sep. 28, 2021 (TW) ..... 110135994

(51) Int. Cl.
*A63B 23/02* (2006.01)
*A63B 21/00* (2006.01)
*A63B 22/20* (2006.01)

(52) U.S. Cl.
CPC ..... *A63B 23/0211* (2013.01); *A63B 21/4035* (2015.10); *A63B 22/20* (2013.01); *A63B 2208/0219* (2013.01)

(58) Field of Classification Search
CPC . A63B 23/0211; A63B 21/4035; A63B 22/20; A63B 2208/0219; A63B 71/0054; A63B 2071/0072
See application file for complete search history.

(56) References Cited

U.S. PATENT DOCUMENTS 3,752,475 A * 8/1973 Ott ..... A63B 21/0004 482/127
6,328,680 B1 * 12/2001 Shifferaw ..... A63B 21/0618 482/907
8,708,874 B2 * 4/2014 Chen ..... A63B 21/00196 482/110
9,011,303 B2 * 4/2015 MacColl ..... A63B 21/023 482/127
9,808,665 B1 * 11/2017 Demarais ..... A63B 21/4035
10,004,942 B1 * 6/2018 Huang ..... A63B 22/20
10,046,198 B1 * 8/2018 Huang ..... A63B 22/20
(Continued)

FOREIGN PATENT DOCUMENTS

CN 206688106 U 12/2017
CN 206688109 U 12/2017
(Continued)

*Primary Examiner* — Garrett K Atkinson
(74) *Attorney, Agent, or Firm* — Best & Flanagan LLP

(57) ABSTRACT

An adjustable ab wheel has a main shaft and two wheels mounted on the main shaft. The main shaft has two external threaded sections. Each one of the two external threaded sections has a thread direction opposite to the thread direction of the other one of the two external threaded sections. Each one of the two wheels has a threaded hole axially defined through the wheel and mounted with a respective one of the two external threaded sections. When a user rolls the two wheels forward, the two wheels approach each other and abut against each other. Abutment between the two wheels allows the two wheels to brake themselves, so that the adjustable ab wheel can prevent users from over rolling the two wheels forward and suddenly falling down to the floor.

6 Claims, 8 Drawing Sheets

(56) References Cited

U.S. PATENT DOCUMENTS

| | | | | |
|---|---|---|---|---|
| 2003/0050153 | A1* | 3/2003 | Stevens | A63B 21/0603 482/92 |
| 2005/0202944 | A1* | 9/2005 | Deal | A63B 21/0004 482/121 |
| 2009/0247375 | A1* | 10/2009 | Smith | A63B 21/22 482/110 |
| 2012/0157274 | A1* | 6/2012 | MacColl | A63B 21/00185 482/132 |
| 2013/0017936 | A1* | 1/2013 | Olson | A63B 21/4049 482/132 |

FOREIGN PATENT DOCUMENTS

| | | | | |
|---|---|---|---|---|
| TW | M540667 | U | * | 5/2017 |
| TW | M545611 | U | | 7/2017 |
| TW | I738604 | B | | 9/2021 |
| TW | 202227163 | A | * | 7/2022 |

* cited by examiner

ADJUSTABLE AB WHEEL

BACKGROUND OF THE INVENTION

1. Field of the Invention

The present invention relates to fitness equipment, and more particularly to an adjustable ab wheel.

2. Description of Related Art

An ab wheel is a kind of indoor sport equipment. A conventional ab wheel has at least one wheel and a shaft. The at least one wheel is mounted on the shaft and is rotatable around the shaft. When using the conventional ab wheel, a user starts with both knees on the floor and hold the shaft. Then, the user can roll the wheel back and forth on the floor to train their muscle for fitness.

To make the conventional ab wheel more convenient in use, some improved ab wheels have been developed. For example, TW patent 1738604 discloses another conventional ab wheel having a wheel and a shaft. The shaft has an external threaded section on the middle of the shaft and two sheathing sections. Two handles are respectively mounted on the two sheathing sections. A threaded hole axially defined through a center of the wheel is movably mounted on and around the external threaded section of the shaft. When a user rolls the wheel forward, the wheel also moves along the external threaded section and abuts against one of the two handles. With abutment between the wheel and one of the two handles, the wheel cannot be rolled forward anymore. When the user cannot roll the ab wheel backward due to lack of the strength, the technical features of the conventional ab wheel can prevent the user from over rolling the wheel forward and suddenly falling down to the floor.

However, the conventional ab wheel mentioned above has the following weakness. Since the ab wheel has only one wheel, the wheel becomes near one of two ends of the shaft when abutting against one of the two handles, which makes weight distribution of the ab wheel uneven. Thereby, the user may lean, fall down to the ground, and get injured.

With reference to FIG. 8, another conventional ab wheel disclosed by TW utility model M545611 has a shaft, two handles 70, and two rollers 80. The shaft has a right hand thread segment 61 and a left hand thread segment 62 symmetrically formed on the surface of the shaft, and a block disposed between the right hand thread segment 61 and the left hand thread segment 62. Each one of the two handles 70 has a connecting ring and an inner thread hole, and each one of the two rollers 80 mounted on respective one of two ends of the shaft. The two handles 70 respectively mounted with the right hand thread segment 61 and the left hand thread segment 62 via the inner thread hole, and at least one elastic piece 50 is connected between two said connecting rings of the two handles 70. When a user rolls the two rollers 80 back and forth, the two handles 70 also move inward and outward. The two handles 70 may approach each other and abut against the block, so that the user cannot roll the two rollers 80 forward anymore. The conventional ab wheel thus prevent the user from over rolling the wheel forward and suddenly falling down to the floor as the first-mentioned conventional ab wheel.

However, the conventional ab wheel disclosed by TW utility model M545611 has the following weakness. With reference to FIG. 8, when a user rolls the two rollers 80 of the conventional ab wheel back and forth, the user's arms approach each other or move away from each other as the two handles 70 move, which leads to overloading fitness effect. Moreover, the user's body and arms go up and down when rolling the two rollers 80 of the conventional ab wheel, and it is really difficult and dangerous for the user to make the user's arms approach each other or move away from each other when the user's body and arms go up and down. The user's hands may easily separate from the two handles 70 and thereby the user may fall down to the ground and get injured. The conventional ab wheel can be dangerous in use and may only be suitable for professional fitness coaches or experienced fitness amateurs.

To overcome the shortcomings of the conventional ab wheel mentioned above, the present invention tends to provide an adjustable ab wheel to mitigate or obviate the aforementioned problems.

SUMMARY OF THE INVENTION

The main objective of the present invention is to provide users with an adjustable ab wheel that may have wheels able to brake themselves and prevent users from getting injured.

The adjustable ab wheel comprises a main shaft and two wheels mounted on the main shaft. The main shaft has two external threaded sections extending from a middle section of the main shaft and respectively toward the two opposite ends of the main shaft. Each one of the two external threaded sections has a thread direction which is opposite to the thread direction of the other one of the two external threaded sections. Each one of the two wheels has a threaded hole axially defined through the wheel and mounted with a respective one of the two external threaded sections. The two wheels move along the corresponding external threaded sections to approach and abut against each other or to move away from each other when the two wheels rotate around the main shaft. When a user rolls the two wheels forward, the two wheels approach each other and abut against each other, which allows the two wheels to brake themselves. Thereby, the adjustable ab wheel can prevent users from over rolling the two wheels forward and suddenly falling down to the floor.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
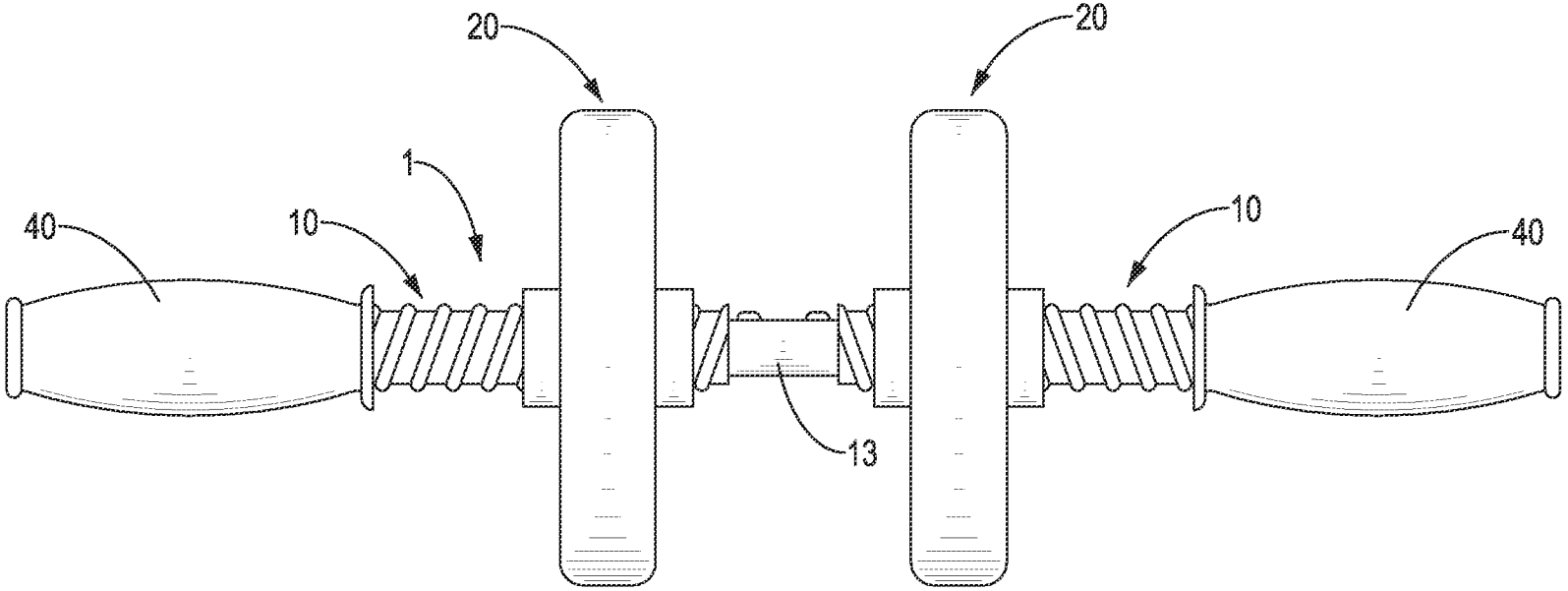
FIG. 1 is a front side view of a first preferred embodiment of an adjustable ab wheel in accordance with the present invention.

With reference to FIG. 1, a first preferred embodiment of an adjustable ab wheel in accordance with the present invention has a main shaft 1, two wheels 20, and two handles 40.

With reference to FIG. 1, the main shaft 1 has two opposite ends and two external threaded sections 11. The two external threaded sections 11 extend from a middle section of the main shaft 1 and respectively toward the two opposite ends of the main shaft 1. Each one of the two external threaded sections 11 has a thread direction which is opposite to the thread direction of the other one of the two external threaded sections 11.

Figure 2:
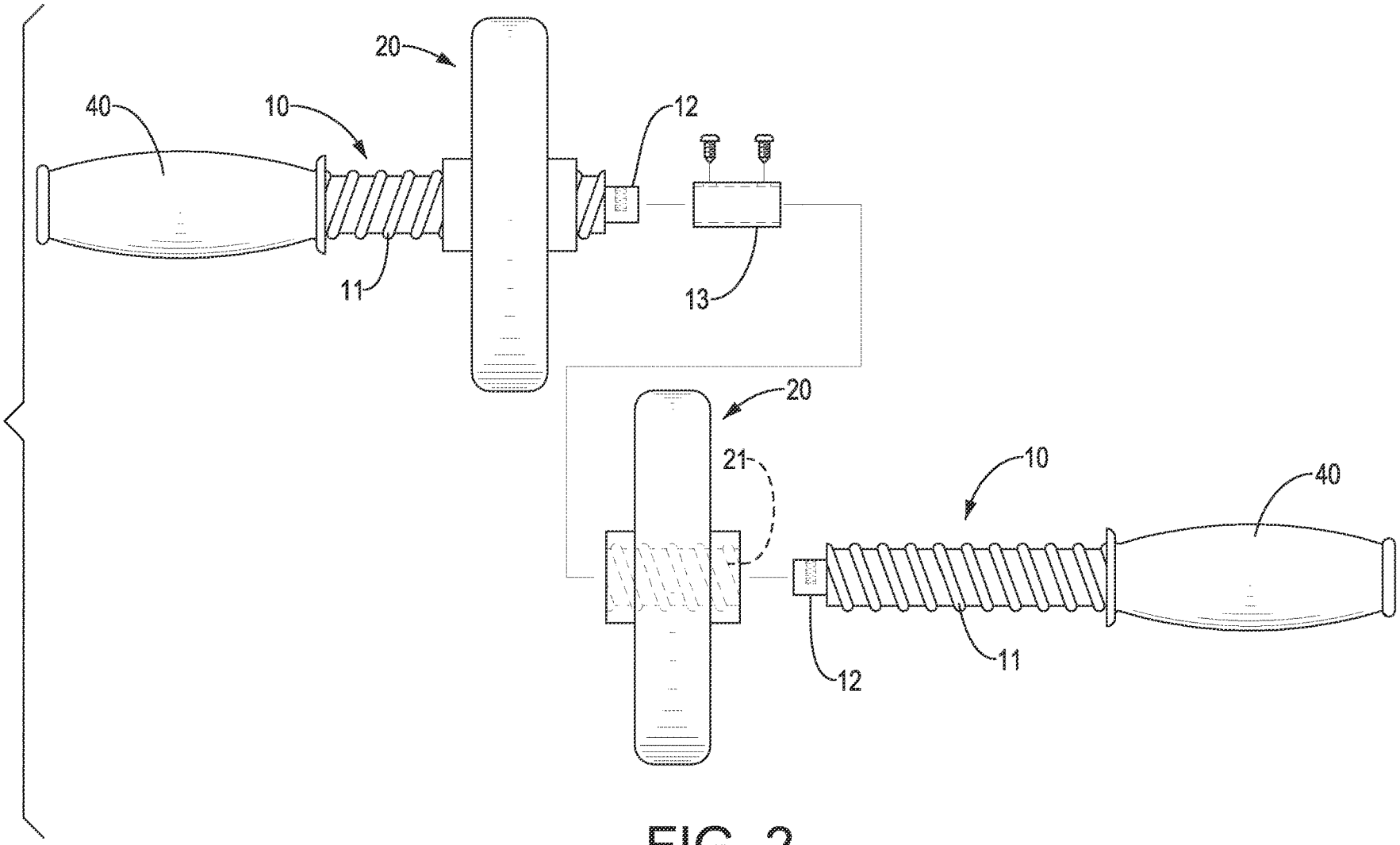
FIG. 2 is a partial exploded front side view of the adjustable ab wheel in FIG. 1.

With reference to FIG. 2, in the first preferred embodiment, the main shaft 1 has two shaft bodies 10, and the two external threaded sections 11 are respectively disposed on the two shaft bodies 10. Each one of the two shaft bodies 10 has a connecting portion 12, and the main shaft 1 further has a connecting unit 13 coaxially connecting the two shaft bodies 10. The connecting unit 13 is tubular in shape, and each one of two said connecting portions 12 of the two shaft bodies 10 is inserted into the connecting unit 13 from a respective one of two ends of the connecting unit 13 and is combined with the connecting unit 13. In this preferred embodiment, each one of two said connecting portions 12 of the two shaft bodies 10 is combined with the connecting unit 13 via a bolt. In fact, the connecting portion 12 can be combined with the connecting unit 13 via a rivet, a clip, or other fastening unit in other embodiments, which is not limited by the preferred embodiment above.

With reference to FIG. 2, each one of the two wheels 20 has a threaded hole 21 axially defined through the wheel 20. The threaded hole 21 is mounted with a respective one of the two external threaded sections 11 of the main shaft 1. Thereby, when the two wheels 20 rotate around the main shaft 1, the two wheels 20 also move linearly along the corresponding external threaded sections 11 to approach each other and abut against each other or to move away from each other.

With reference to FIGS. 1 and 2, each one of the two handles 40 is mounted on a respective one of the two opposite ends of the main shaft 1. In this embodiment, the two handles 40 are respectively mounted on the two shaft bodies 10.

Figure 3:
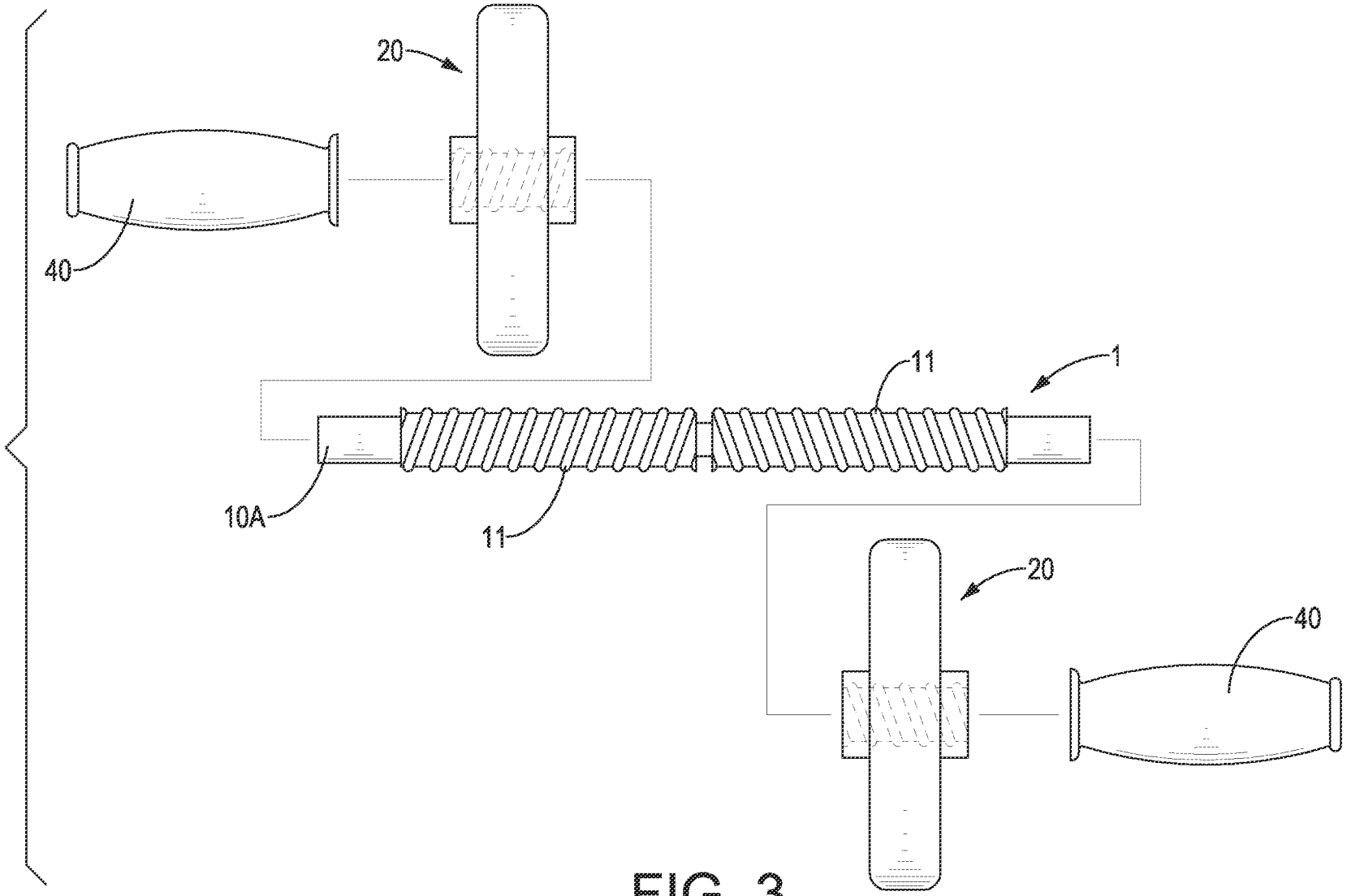
FIG. 3 is an exploded front side view of a second preferred embodiment of an adjustable ab wheel in accordance with the present invention.

With reference to FIG. 3, a second preferred embodiment of an adjustable ab wheel in accordance with the present invention is shown. The second preferred embodiment and the first preferred embodiment are basically the same. The difference is that the main shaft 1 of the second preferred embodiment has only one shaft body 10A. The shaft body 10A is a one-piece component and is elongated, and the two external threaded sections 11 are both disposed on the shaft body 10A. The two handles 40 are respectively mounted on two opposite ends of the shaft body 10A.

Figure 4:
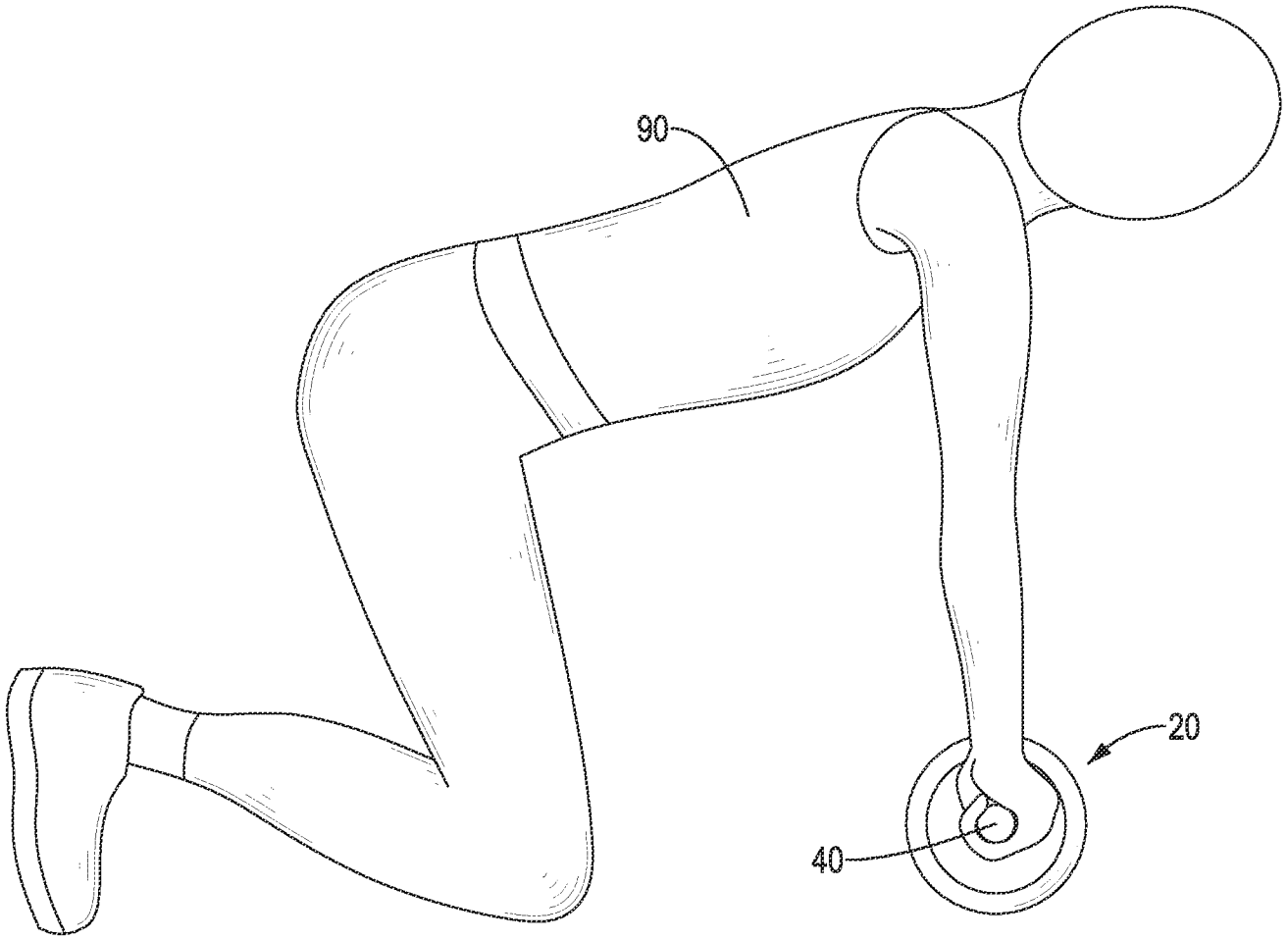
FIG. 4 is an operational side view of the adjustable ab wheel in FIG. 1.
Figure 5:
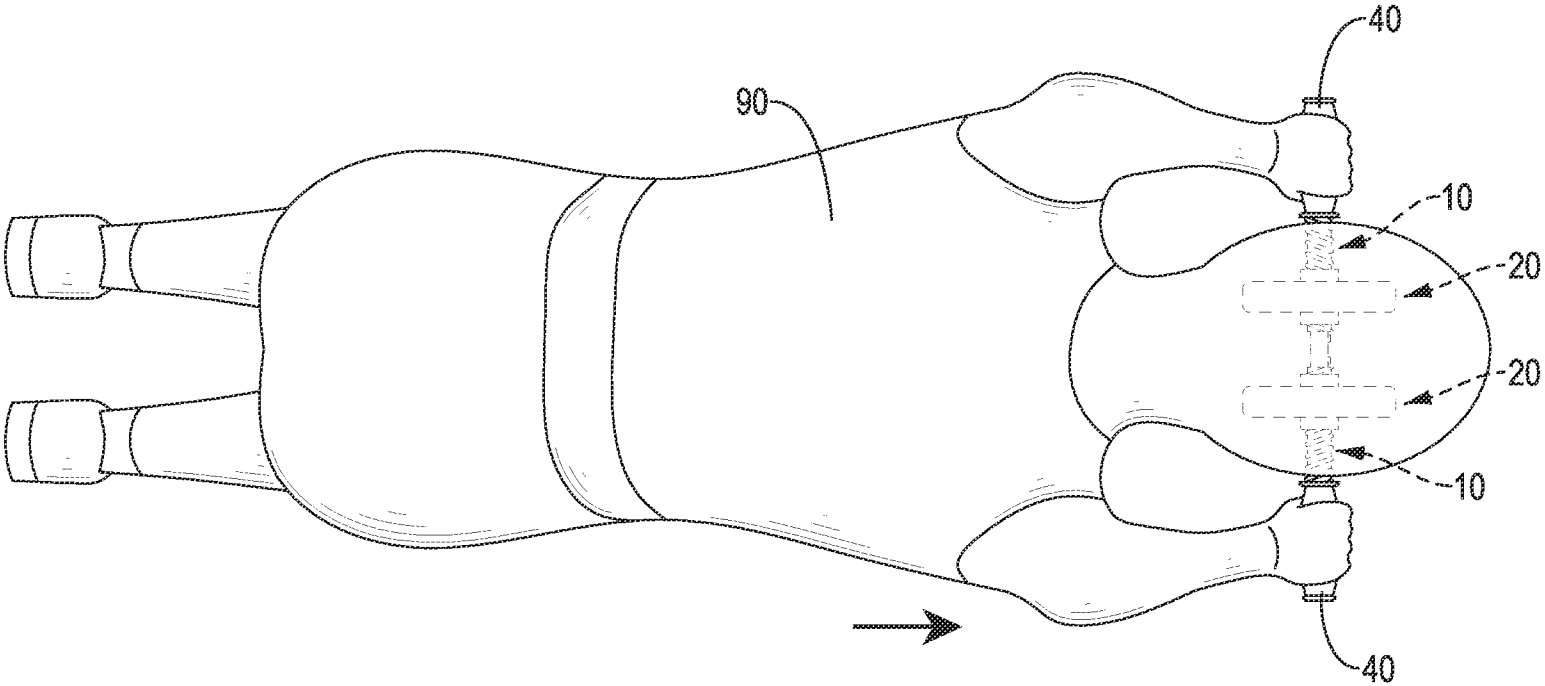
FIG. 5 is an operational top side view of the adjustable ab wheel in FIG. 1.
Figure 6:
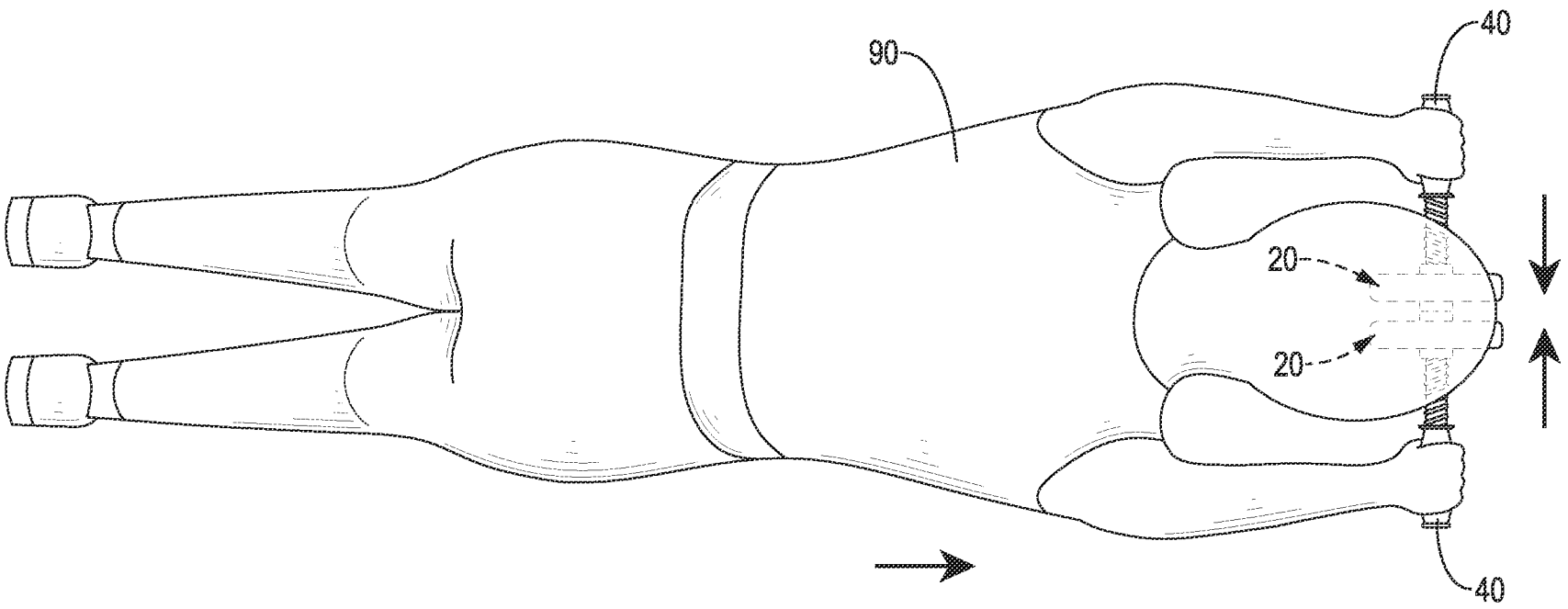
FIG. 6 is another operational top side view of the adjustable ab wheel in FIG. 1.

In use, with reference to FIG. 4, a user 90 starts with both knees and the adjustable ab wheel on the floor and holds the two handles 40 of the adjustable ab wheel in a preparing position. Then, with reference to FIG. 5, the user 90 begins to roll the adjustable ab wheel forward on the floor, and the user's body gradually stretches. As the user 90 rolls the two wheels 20 forward, the two wheels 20 rotate around the main shaft 1, move along the corresponding external threaded sections 11, and gradually approach each other. After the user 90 rolls the two wheels 20 forward for a certain distance, with reference to FIG. 6, the two wheels 20 abut against each other and cannot be rolled forward anymore. Abutment between the two wheels 20 allows the two wheels 20 to brake themselves. Thereby, the adjustable ab wheel prevents the user 90 from over rolling the two wheels 20 forward and suddenly falling down to the floor.

The conventional ab wheel described in the prior art has only one wheel, which makes weight distribution of the ab wheel uneven when the only one wheel abuts against one of the two handles; the user 90 may lean and fall down to the floor due to the uneven weight distribution. In comparison, the adjustable ab wheel in accordance with the present invention has the two wheels 20 moving simultaneously and able to brake themselves by abutting against each other. When the user 90 rolls the two wheels 20, the two wheels 20 move along the corresponding external threaded sections 11 to approach each other or to move away from each other, which keeps a center of gravity of the adjustable ab wheel at a same position on the adjustable ab wheel and keeps weight distribution of the adjustable ab wheel even. The adjustable ab wheel thus prevents the user 90 from leaning and falling down to the floor.

Figure 7:
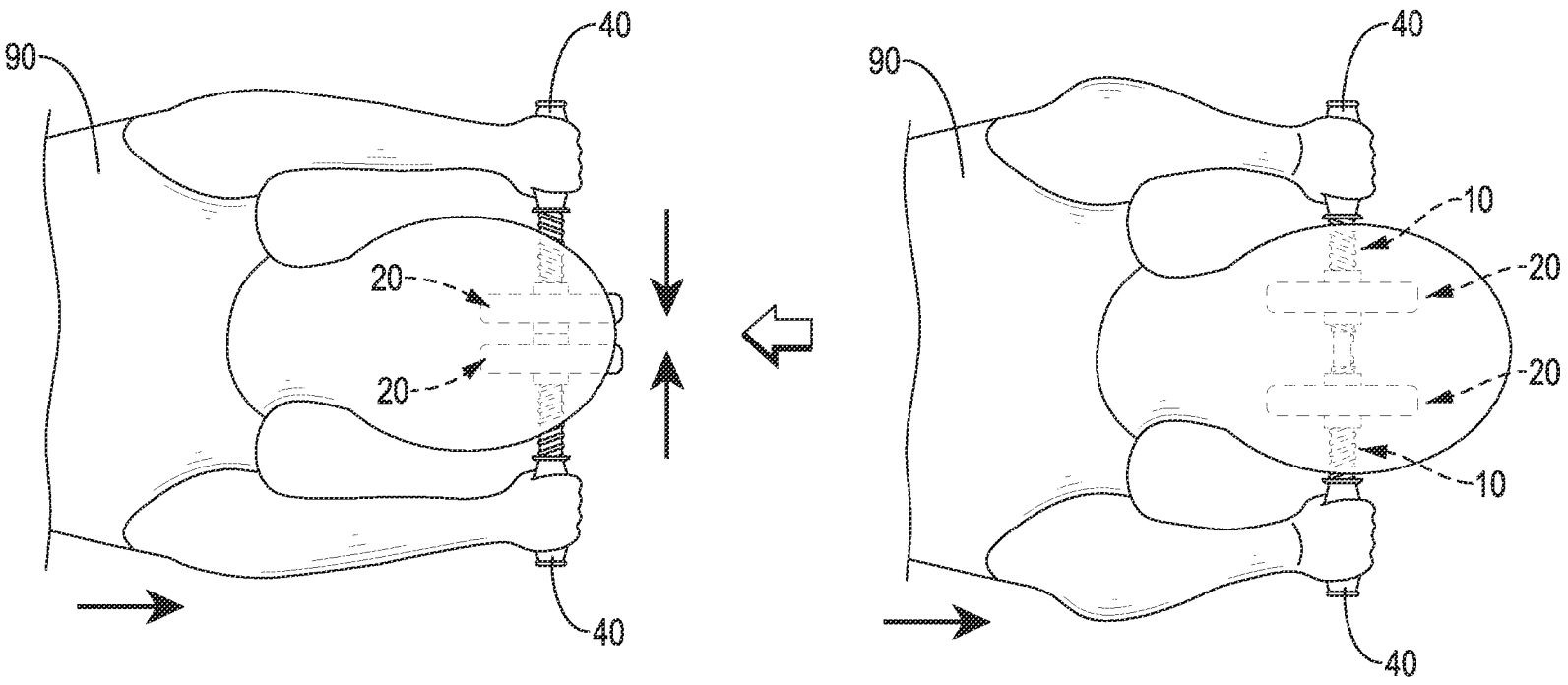
FIG. 7 is another operational top side view of the adjustable ab wheel in FIGS. 1.
Figure 8:
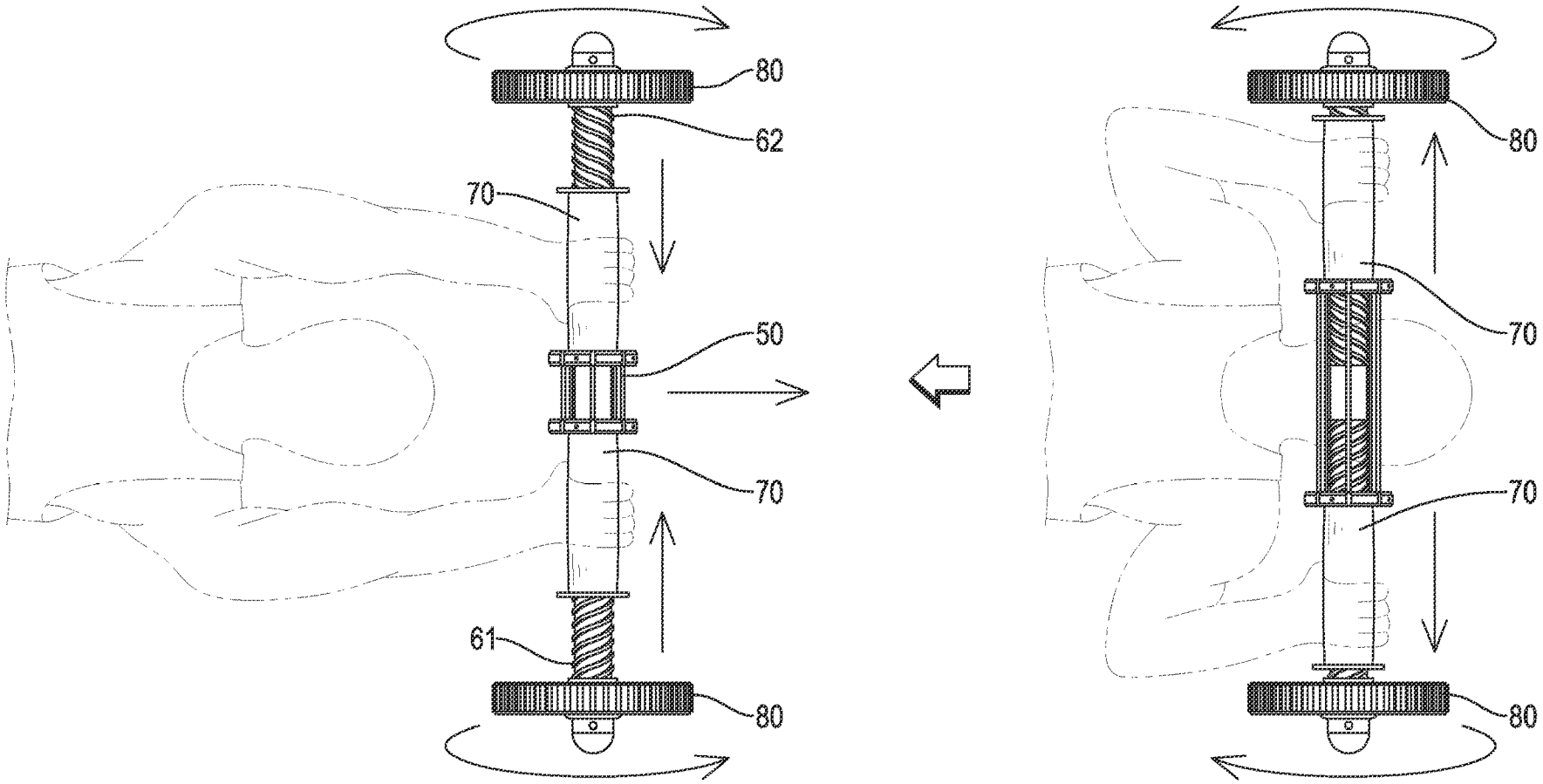
FIG. 8 PRIOR ART
FIG. 8 is an operational top side view of a conventional ab wheel in accordance with the prior art.

In addition, with reference to FIG. 7, when the user 90 rolls the two wheels 20 of the adjustable ab wheel, the two handles 40 do not move, so that user's arms do not approach each other or move away from each other as the user's body and arms go up and down. Compared to the conventional ab wheel shown in FIG. 8 in accordance with the prior art, the adjustable ab wheel has higher safety in use and is suitable not only for professional fitness coaches and experienced fitness amateur but also for fitness beginners or children.

Furthermore, before using the adjustable ab wheel, a user can first rotate the two wheels 20 and make the two wheels 20 move linearly along the corresponding external threaded sections 11 to change a distance between the two wheels 20. For a user such as a professional fitness coach or an experienced fitness amateur, the user can lengthen the distance between the two wheels 20 before using the adjustable ab wheel. Before the two wheels 20 abut against each other and brake themselves, the user has to roll the two wheels 20 forward for a longer distance and thus the intensity of fitness is increased. Likewise, for a user such as a fitness beginner or a child, the user can shorten the distance between the two wheels 20 before using the adjustable ab wheel. Thus, the user does not need to roll the two wheels 20 forward too long before the two wheels 20 abut against each other and brake themselves. The adjustable ab wheel thus allows users to adjust the intensity of fitness based on their own situation and need.

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable ab wheel comprising:

a main shaft having two opposite ends; and two external threaded sections extending from a middle section of the main shaft and respectively toward the two opposite ends of the main shaft, and each one of the two external threaded sections having a thread direction being opposite to the thread direction of the other one of the two external threaded sections; and two wheels, each one of the two wheels having a threaded hole axially defined through the wheel and mounted with a respective one of the two external threaded sections of the main shaft;

wherein the two wheels move linearly along the corresponding external threaded sections to approach and abut against each other or to move away from each other when the two wheels rotate around the main shaft.

2. The adjustable ab wheel as claimed in claim 1, wherein the adjustable ab wheel has two handles, and each one of the two handles is mounted on a respective one of the two opposite ends of the main shaft.

3. The adjustable ab wheel as claimed in claim 2, wherein the main shaft has two shaft bodies; and a connecting unit coaxially connecting the two shaft bodies; and the two external threaded sections are respectively disposed on the two shaft bodies.

4. The adjustable ab wheel as claimed in claim 3, wherein the connecting unit is tubular in shape;

each one of the two shaft bodies has a connecting portion; and each one of two said connecting portions of the two shaft bodies is inserted into the connecting unit from a respective one of two ends of the connecting unit and is combined with the connecting unit via a bolt.

5. The adjustable ab wheel as claimed in claim 1, wherein the main shaft has two shaft bodies; and a connecting unit coaxially connecting the two shaft bodies; and the two external threaded sections are respectively disposed on the two shaft bodies.

6. The adjustable ab wheel as claimed in claim 5, wherein the connecting unit is tubular in shape;

each one of the two shaft bodies has a connecting portion; and each one of two said connecting portions of the two shaft bodies is inserted into the connecting unit from a respective one of two ends of the connecting unit and is combined with the connecting unit via a bolt.

* * * * *